United States Patent [19]

Mann

[11] Patent Number: 5,005,546

[45] Date of Patent: Apr. 9, 1991

[54] SETTING DEVICE FOR A FEED DEVICE OF AN INTERNAL COMBUSTION ENGINE

[75] Inventor: Arnold Mann, Biebergemünd, Fed. Rep. of Germany

[73] Assignee: VDO Adolf Schindling AG, Frankfurt am Main, Fed. Rep. of Germany

[21] Appl. No.: 419,642

[22] Filed: Oct. 11, 1989

[30] Foreign Application Priority Data

Dec. 22, 1988 [DE] Fed. Rep. of Germany ..... 3843147

[51] Int. Cl.[5] ..... F02D 9/02

[52] U.S. Cl. ..... 123/339

[58] Field of Search ..... 123/339, 396, 403

[56] References Cited

U.S. PATENT DOCUMENTS

| | | | |
|---|---|---|---|
| 3,354,877 | 11/1967 | Zub et al. | 123/198 DA |
| 3,721,222 | 3/1973 | Shioya et al. | 123/339 |
| 4,059,088 | 11/1977 | Tateno et al. | 123/328 |
| 4,354,466 | 10/1982 | Dudley et al. | 123/339 |
| 4,513,785 | 4/1985 | Kenny | 123/339 |
| 4,569,321 | 2/1986 | Bonfiglioli et al. | 123/339 |

FOREIGN PATENT DOCUMENTS

| | | |
|---|---|---|
| 0208222 | 4/1987 | European Pat. Off. . |
| 3410993 | 9/1985 | Fed. Rep. of Germany . |
| 2063793 | 7/1971 | France . |
| 2248417 | 5/1975 | France . |

*Primary Examiner*—Andrew M. Dolinar

*Attorney, Agent, or Firm*—Martin A. Farber

[57] ABSTRACT

A setting device is provided for a feed device, in particular the throttle valve of an internal combustion engine with idling speed control, in which the throttle valve is located in the intake manifold. The throttle valve is connected to a displacement rod and pretensioned by a return spring. A first, adjustable stop and a second, fixed stop are provided for an actuating lever of the throttle valve. The second, fixed stop limits the adjustment range of the first stop for a minimal opening of the throttle valve. An idle stop, which is preferably developed as single-piece lever, acts with the actuating lever. By cooperation of the idle stop lever with the two stops, there is assured, on the one hand, a control of the idle position of the throttle valve, in which case a minimal opening position is established, while, on the other hand, an idle position of the throttle valve with a somewhat larger opening than the minimal opening is assured in the event that the idle speed control fails or becomes defective.

7 Claims, 2 Drawing Sheets

SETTING DEVICE FOR A FEED DEVICE OF AN INTERNAL COMBUSTION ENGINE

FIELD AND BACKGROUND OF THE INVENTION

The present invention relates to a setting device for a feed device of an internal combustion engine, wherein the feed device provides control of the speed of rotation upon idling, is connected to an adjusting rod, and is pretensioned by a return spring. The feed device includes a first adjustable stop and a second fixed stop operable with an actuating lever of the feed device, the second fixed stop limiting a range of adjustment of the first stop for a minimum setting of the feed device.

In order to reduce the consumption of fuel and thus the amount of the exhaust and the emission of noise, it is known to adjust the idling speed of an internal combustion engine at the lower limit of the value required for smooth operation. This minimum value, however, varies greatly with various operating conditions; for instance after a cold start in the winter or upon an added load, such as air conditioning or hydraulic power assistance, it is much larger than in the case of a warmed-up engine without load. If a stop of the feed device, i.e. of the throttle valve or the control rod an injection pump, determines the idling speed, then the adjustment range of this stop must be correspondingly large in order to satisfy the control requirements for all operating conditions which may occur. It is desirable or even necessary for reasons of safety that the idling control be reduced to the smallest possible value upon a failure or an error in control in order reliably to avoid dangerous operating conditions due to an excessively high idling speed of rotation which can lead to forward movement of the vehicle. Upon an operating condition of the internal combustion engine which would, in principle, require an increase in the idling speed, the displacement of the idling stop to the minimum value however leads to rough idling or stalling, so that it is extremely difficult to move at all a vehicle the idling control of which has failed. There is thus a demand for setting devices which still permit emergency travel with a sufficient idling speed after failure of the idling control.

SUMMARY OF THE INVENTION

The setting device according to a main feature of the invention therefore has a movable abutment on a actuating lever of the throttle valve. The abutment, upon a controlled adjustment of the idling speed, is kept out of engagement with a fixed stop for said actuating lever. The abutment comes automatically into engagement with the stop upon failure of the idle control, whereby a throttle valve gap is set which is clearly greater than the minimum open position of the throttle valve and which results in increased idling speed. The driver can thus safely continue driving in case of a malfunction in order to look for a repair shop.

It is an object of the present invention to provide a setting device of the type indicated above which requires few parts and is reliable in operation.

Accordingly, the invention provides an idling stop lever (21) in one piece which cooperates with the actuating lever (13) and can be adjusted by an idle setting device (23). The stop lever has at least two stops (28, 30) located at different places for cooperation with at least two abutment surfaces (29, 32) located at different places on the actuating lever (13). The pairs of abutment surfaces (28, 29, 30 and 32) can be alternately brought into operative connection with each other.

It is advantageous in this connection that the setting device does not have additional components for emergency travel. It is also advantageous that the setting device is constructed in simple and space-saving fashion and that the sole part, which represents the movable stop, can be counterbalanced with respect to the vibrations acting on it due to the operation of the internal combustion engine.

It is advantageous in this connection that a signal part alternately represents the fixed stop and the movable stop. It is furthermore of advantage that the characteristic curve of the setting device can be freely selected by the length of the lever arms. It is also advantageous that there is an approximately proportional relationship between the setting signal and the path of the actuating lever within the adjustment range. There is finally the advantage that the idle stop lever serves for the adjustment of the fixed stop without the movable stop being substantially affected.

According to a feature of the invention, the idle stop lever (21) is fork-shaped on its side facing the actuating lever (13) and each branch (25, 27) of the fork bears a stop surface (28, 30).

According to a further feature of the invention, the stop surfaces for the adjustable stop (28, 29) are curved in the plane of the drawing.

Still another feature of the invention is that said curvature is so selected that a tangent to the corresponding point of contact coincides or approximately coincides with a line connecting the two axes of rotation of the actuating lever (13) and the idle stop lever (21).

Furthermore, according to the invention, the shaft (20) of the idle stop lever (21) is mounted eccentrically adjustable, as by use of an enlarged aperture for supporting the shaft.

BRIEF DESCRIPTION OF THE DRAWINGS

With the above and other objects and advantages in view, the present invention will become more clearly understood in connection with the detailed description of the preferred embodiments, when considered with the accompanying drawing, of which.

DETAILED DESCRIPTION OF THE PREFERRED EMBODIMENTS

Figure 1A:
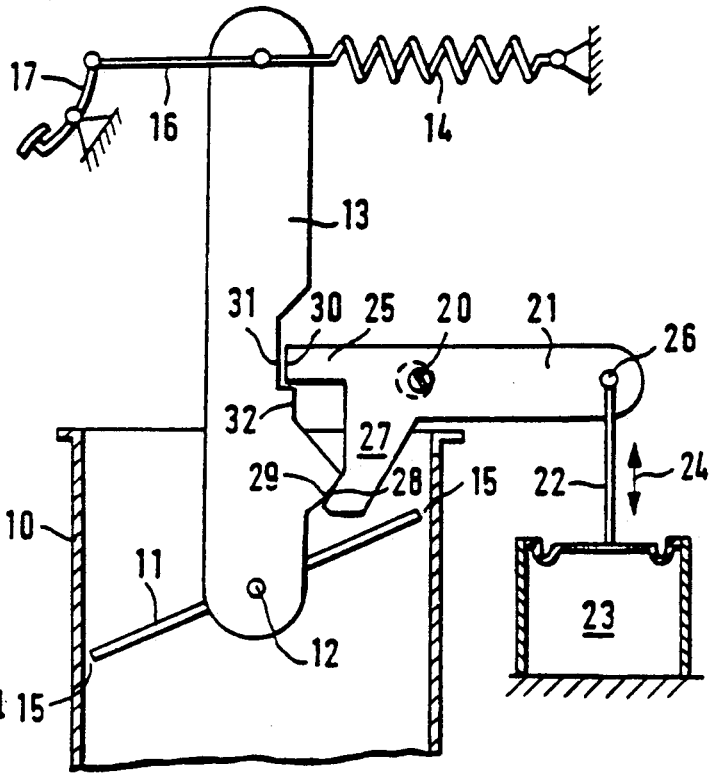
FIG. 1 includes FIGS. 1*a*, 1*b* and l*c* and is a first embodiment of the invention, shown in different operating conditions.

In FIG. 1 a throttle valve 11 is mounted in the intake manifold 10 of an internal combustion engine (indicated diagrammatically) in conventional manner on a throttle-valve shaft 12 which extends transversely through the cross section of the intake manifold. On the throttle valve shaft 12 there is mounted fixed against twisting, and actuating lever 13. To the free end of the actuating lever 13 there is attached a return spring 14, developed as tension spring, which endeavors to pull the throttle valve 11 against a stop (which will be described further below) into a closed position in which the intake manifold cross section is blocked except for a small air gap 15. The size of the air gap 15 determines the idle speed prevailing at the time. Via a rod 16, an accelerator pedal 17 also acts on the free end of the actuating lever 13, opposite the direction of action of the return spring 14, by which accelerator pedal the throttle valve 11 can therefore be moved as desired and the engine load can be determined.

An idle stop lever 21 is swingably mounted on a shaft, a side of the actuating lever 13 being aligned with the shaft. The idle stop lever 21 is connected at its free end via a rod 22 to an idling adjustment device indicated at 23. The idling adjustment device 23 can act electrically, hydraulically or pneumatically. As a function of electrical signals or of hydraulic or pneumatic pulses of the idling control it displaces the rod 22 in the directions of the double arrow 24 and thus swings the idle stop lever 21 correspondingly in clockwise or counterclockwise direction. Depending on the operating conditions of the internal combustion engine at the time, which are detected and evaluated by the idling control (indicated diagrammatically), or of the idling control itself, the idling stop lever 21 provides in this connection different idle stops for the actuating lever 13 and thus for the throttle valve 11.

For this purpose, the idle stop lever 21 of FIG. 1 is forked on the side facing the actuating lever 13, namely in the manner that a first branch 25 extends approximately in the extension of the connecting line between a point of attack 26 of the rod 22 on the idle stop lever 21 and its pivot shaft 20. The second branch 27 points approximately perpendicular thereto in the direction of the throttle valve shaft 12 and has, approximately on the connecting line between the shaft 20 of the idle stop lever 21 and the throttle valve shaft 12, a spherical stop surface 28 which can be brought into operative connection with a similar stop surface 29 of the actuating lever 13. The curvature and direction of the corresponding stop surface is in this case advisedly so selected that the tangent at the corresponding point of contact or, stated more precisely, the tangent in the plane of the drawing in the corresponding line of contact coincides with the above-mentioned connecting line. This results in a harmonious course of movement without abrupt changes in the angular speed of the actuating lever 13 and with slight surface pressures.

A front-side stop surface 30 of the branch 25 of the forked idle stop lever 21 can be brought correspondingly into operative connection with a second stop surface 31 of the actuating lever 13. The stop surface 31 is shifted laterally with respect to an adjacent third stop surface 32 of the actuating lever 13, namely in the direction away from the stop surface 30 and shaft 20. The stop surface 30 of the idle stop lever 21 can also be brought into operative connection with the third stop surface 32 of the actuating lever 13 of the throttle valve 11, as will be explained below.

FIG. 1*a* shows the setting device in its starting position. The actuating lever 13 is, in this case, turned in clockwise direction under the action of the return spring 14 until it rests against one or two of the stop surfaces 28, 30 of the idle stop lever 21. Assuming that the internal combustion engine has reached its operating temperature and is running without additional load, the position of the idle stop lever 21 corresponds to that shown in FIG. 1*a*. In this case, both the stop surface 30 of the idle stop lever 21 and the stop surface 29 of the actuating lever 13 rest against the stop surface 28 of the actuating lever 21. This corresponds to the greatest degree of closure of the throttle gap 15 and thus to the smallest feed of idling air.

As already mentioned above, the addition of load and/or an unfavorable operating temperature may require an increase in the idling speed by a further opening of the throttle gap 15. Proceeding from the starting condition shown in FIG. 1*a*, the idling adjustment device 23, which is henceforth assumed to act electrically, will receive signals from the idling control, which by a pull on the rod 22 lead to a turning of the idle stop lever 21 in clockwise direction. Via the operative connection of the stop surfaces 28, 29, the actuating lever 13 is thereby turned in counterclockwise direction and the throttle gap 15 is widened (FIG. 1*c*). This takes place until the idling control recognizes that the speed level of the internal combustion engine in idle state is sufficiently high under the operating load conditions determined, i.e. that it corresponds to the desired value.

The idling adjustment device 23 is advisedly a so-called current-path adjustment device in which a deflection of the rod out of the starting position takes place proportional to current acting on it or in accordance with some other relationship.

Figure 1B:
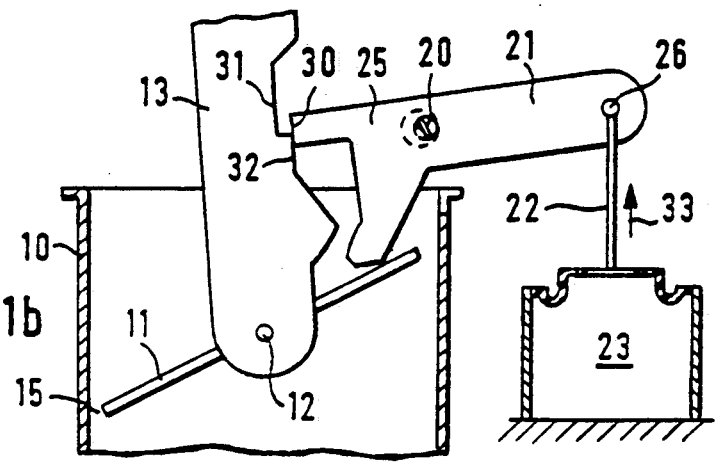
Figure 1C:
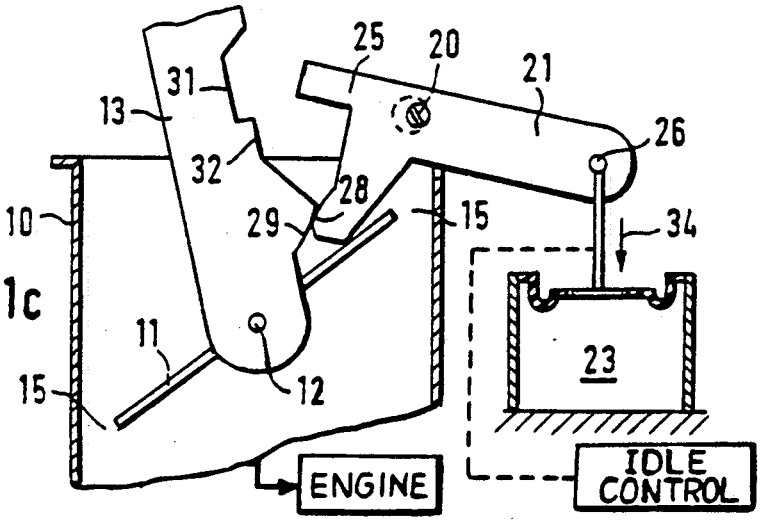

FIG. 1*b* shows functioning of the setting device in an abnormal operating condition of the idling control, for instance upon the failure thereof. In this case, the idling adjustment device 23 is without current and the rod 22 moves under the action of a spring (not shown) in the idling adjustment device in a direction of the arrow 33 into the upper starting position. The idle stop lever 21 is turned in counterclockwise direction, in which case, depending on the instantaneous position of the actuating lever used for the development of the power of the internal combustion engine, the position of the idle stop lever 21 corresponds either to FIG. 1*a* or to FIG. 1*c*. If, in the position of FIG. 1*a*, the idle stop lever 21 is engaged with the actuating lever 13, then a single brief giving of gas is sufficient to release the idle stop lever 21. It then continues to turn in counterclockwise direction under the influence of the spring in the idling adjustment device 23 until the stop surface 32 of the actuating lever 13 rests against the stop surface 30 of the idle stop lever 21. Compared with the starting position, this corresponds to a still further opened throttle gap 15 with increased idling speed. Emergency travel until reaching the next possibility for repair is thus assured.

If the abnormal operating condition of the idling control is only temporary, then the idling adjustment device 23 can become active again at any time and control the idling speed of the internal combustion engine with a view toward optimum operating behavior and mimimum emission of noxious substances.

Figure 2A:
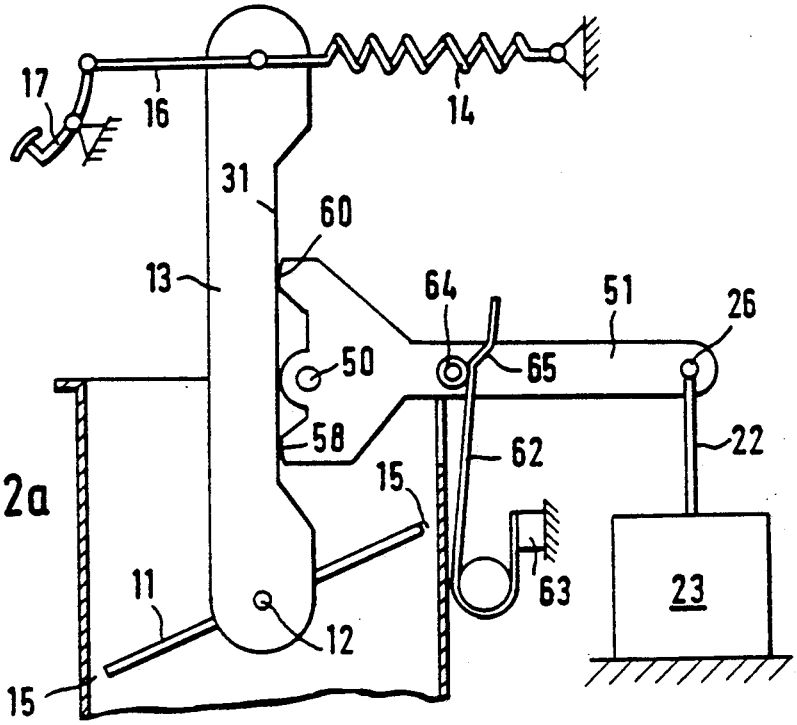
FIG. 2 includes FIGS. 2*a*, 2*b* and 2*c* and is a different embodiment of the invention, also shown in different operating conditions which are comparable to those of FIG. 1.
Figure 2B:
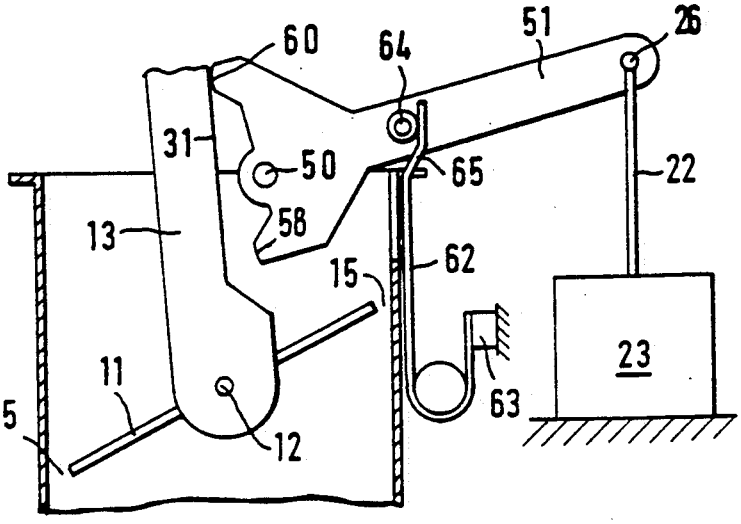
Figure 2C:
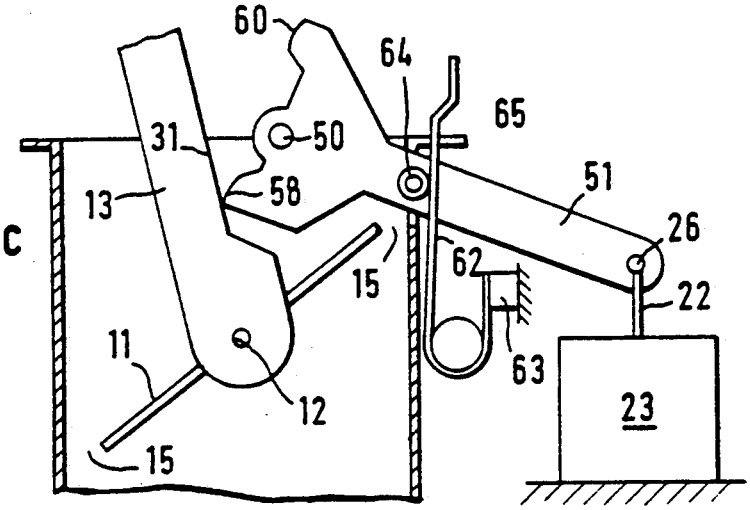

In a second embodiment of the invention, shown in FIG. 2, the necessity of actuating the accelerator pedal in order to arrive at emergency travel upon abnormal operation of the idling control device is dispensed with. This result is achieved by a development of the idle stop lever and the actuating lever for the throttle valve 11 which differs from the embodiment of FIG. 1. Parts which are the same as those in FIG. 1 and have the same function have been given the same reference numbers.

In FIG. 2, the actuating lever 13 for the throttle valve 11 is connected, in the same manner as in FIG. 1, via a rod indicated at 16 to the accelerator pedal 17, while the return spring 14 pulls the actuating lever 13, and thus the throttle valve, in clockwise direction against the idle stop lever 51. The idle stop lever 51 is connected to the idling adjustment device 23 via the rod 22, and the idling adjustment device 23 can move the idle stop lever 51, proceeding from the position shown in FIG. *2a*, both in counterclockwise direction (FIG. *2b*) and in clockwise direction (FIG. *2c*).

The stop surface 31 of the actuating lever 13 extends in a straight line and cooperates, depending on the position of rotation of the idle stop lever 51, either with its stop surface 60 (FIG. *2b*) or 58 (FIG. *2c*) or with both of them (FIG. *2a*). The fulcrum of the idle stop lever lies approximately in the middle between the two stop surfaces 60 and 58 which protrude slightly with respect to the fulcrum 50 on both sides thereof. Approximately on the connecting line between the fulcrum 50, which lies immediately adjacent to the actuating lever 13, and the pivot point 26 for the rod 22, there is provided a spring stop 64 which cooperates with a hairpin spring 62. The hairpin spring 62 has its fixed end pivoted, fixed in position on a point of attachment 63 while the free end of the hairpin spring 62 is bent approximately at the level of the spring stop 64 in the direction towards the pivot point 26. The bend 65 is in this case so arranged that the spring stop 64 cooperates in the "minimum idling air" position (FIG. *2a*) with the unbent portion of the hairpin spring 62. If the idle stop lever 51, as shown in FIG. *2b*, is deflected in counterclockwise direction to adjust for increased idling air, then the actuating lever 13 must be moved against the force of the return spring 14 in counterclockwise direction by the idling adjustment device 23. The spring stop 64 slides in this connection along the bent part 65 of the hairpin spring 62, the inclined position of the bent part supporting the turning movement of the idle stop lever 51. With a suitable value of the spring force, it is thus made possible that the idling adjustment device 23 need overcome only the difference in moment of rotation between the two springs 14 and 62 and can be made correspondingly small and inexpensive. The hairpin spring 62 supports, in similar manner, the turning movement of the idle stop lever 51 when the lever is turned out of its starting position (FIG. *2a*) in clockwise direction in order to adjust for increased idling air. The spring stop 64 slides in this case along the straight part of the free end of the hairpin spring. The decreasing distance from the spring coil results in increased driving torque, which is definitely desirable in view of the kinematic relationships described.

As can be noted, the idle stop lever 51 can form, in all three positions shown, the stop for the actuating lever 13 without the accelerator pedal having to be actuated for this.

In the embodiment shown in the drawing and described above, the smallest throttle gap is determined by the structural development of the actuating lever and of the idle stop lever. However, it is also possible, within the scope of the invention, to make this throttle gap adjustable depending on each case so as to be able to adjust the most favorable idling speed for each internal combustion engine. For this purpose, one can, for example, either mount the idle stop lever on an eccentrically adjustment shaft or one of the stop surfaces for emergency travel can be developed as front end of an adjusting screw or else both measures can be employed.

I claim:

1. A speed control system for an internal combustion engine, the system providing for control of an idling speed of rotation of the engine, the system comprising:

a feed device for feeding air into the engine, the feed device including an actuating lever;

a setting device for positioning the feed device, the setting device including a pretensioned return spring and an adjusting rod which are connected to the feed device;

an idle setting device;

an idling stop lever which cooperates with the actuating lever and is adjustable by the idle setting device;

a first stop and a second stop disposed on said stop lever and being operable with said actuating lever, the second stop limiting a range of adjustment of the first stop for a minimum setting of the feed device; and wherein there are at least two abutment surfaces located at different places on the actuating lever; and corresponding ones of said abutment surfaces of said actuating lever, and said stops of said stop lever can be brought alternatively into operative connection with each other.

2. A system according to claim 1, wherein the idle stop lever is formed as a fork on a side thereof facing said actuating lever, and each branch of the fork bears one of said stops.

3. A system according to claim 2, wherein the stops of the stop lever are adjustable, and surfaces of the stops are curved with curvature in a plane of movement of the stop lever.

4. A system according to claim 1, wherein the stops of the stop lever are adjustable, and surfaces of the stops are curved with curvature in a plane of movement of the stop lever.

5. A system according to claim 4, wherein said curvature is so selected that a tangent to a corresponding point of contact between stop and abutment surface coincides or approximately coincides with a line connecting an axis of pivot of said actuating lever and an axis of pivot of said idle stop lever.

6. A system according to claim 5, wherein said idle stop lever is pivoted about a shaft mounted eccentrically adjustable to the stop lever.

7. A system according to claim 1, wherein said idling stop lever is constructed in one piece.

* * * * *